US009400104B2

(12) United States Patent
Low et al.

(10) Patent No.: US 9,400,104 B2
(45) Date of Patent: Jul. 26, 2016

(54) FLOW MODIFIER FOR COMBUSTOR FUEL NOZZLE TIP

(71) Applicants: Kevin Joseph Low, Portland, CT (US); James B. Hoke, Tolland, CT (US); Aleksandar Kojovic, Oakville (CA); Andrew Manninen, Grand Haven, MI (US); Sander Niemeyer, Hudsonville, MI (US)

(72) Inventors: Kevin Joseph Low, Portland, CT (US); James B. Hoke, Tolland, CT (US); Aleksandar Kojovic, Oakville (CA); Andrew Manninen, Grand Haven, MI (US); Sander Niemeyer, Hudsonville, MI (US)

(73) Assignees: United Technologies Corporation, Hartford, CT (US); Woodward, Inc., Fort Collins, CO (US)

( * ) Notice: Subject to any disclaimer, the term of this patent is extended or adjusted under 35 U.S.C. 154(b) by 145 days.

(21) Appl. No.: 13/630,439

(22) Filed: Sep. 28, 2012

(65) Prior Publication Data

US 2014/0090394 A1 Apr. 3, 2014

(51) Int. Cl.

| | |
|---|---|
| ***F23D 11/38*** | (2006.01) |
| ***F23R 3/28*** | (2006.01) |
| ***F23D 11/10*** | (2006.01) |

(52) U.S. Cl.

CPC ..... *F23D 11/383* (2013.01); *F23D 11/107* (2013.01); *F23R 3/28* (2013.01); *F23D 2900/00016* (2013.01); *F23R 2900/00004* (2013.01)

(58) Field of Classification Search

CPC ..... F23R 3/14; F23R 3/28; F23R 3/283; F23R 3/286; F23R 2900/00004; F23D 11/107; F23D 11/38; F23D 11/383; F23D 2900/00016

USPC ..... 60/748, 737, 742, 39.463

See application file for complete search history.

(56) References Cited

U.S. PATENT DOCUMENTS

| | | | | |
|---|---|---|---|---|
| 1,398,650 | A | | 11/1921 | Rothwell |
| 1,564,064 | A | | 12/1925 | Hannah |
| 1,713,357 | A | | 5/1929 | St. Clair |
| 3,013,732 | A | * | 12/1961 | Webster ..... B05B 7/04 239/404 |
| 3,337,135 | A | | 8/1967 | Blakely et al. |
| 3,945,574 | A | | 3/1976 | Polnauer et al. |
| 4,013,395 | A | | 3/1977 | Wormser |
| 4,216,652 | A | | 8/1980 | Herman et al. |
| 4,418,543 | A | * | 12/1983 | Faucher et al. ..... 60/742 |
| 4,831,700 | A | | 5/1989 | Halvorsen et al. |
| 4,938,019 | A | | 7/1990 | Angell et al. |

(Continued)

FOREIGN PATENT DOCUMENTS

| | | | |
|---|---|---|---|
| EP | 0689007 | A2 | 12/1995 |
| EP | 1785672 | A2 | 5/2007 |

(Continued)

OTHER PUBLICATIONS

International Search Report and Written Opinion from PCT Application Serial No. PCT/US2013/062361; dated Jan. 27, 2014, 13 pages.

(Continued)

*Primary Examiner* — William H Rodriguez
*Assistant Examiner* — Jason H Duger
(74) *Attorney, Agent, or Firm* — Fish & Richardson P.C.

(57) ABSTRACT

A fuel injector nozzle assembly includes a body extending along an axis and a core swirl plug positioned at least partially within the body. The core swirl plug has a flow modifying structure configured to swirl fuel at a location upstream from a distal end of the nozzle assembly.

27 Claims, 3 Drawing Sheets

(56) References Cited

U.S. PATENT DOCUMENTS

| | | | | |
|---|---|---|---|---|
| 4,938,417 | A | 7/1990 | Halvorsen | |
| 4,962,889 | A | 10/1990 | Halvorsen | |
| 4,970,865 | A | 11/1990 | Shekelton et al. | |
| 5,014,918 | A | 5/1991 | Halvorsen | |
| 5,174,504 | A | 12/1992 | Halvorsen | |
| 5,267,442 | A | 12/1993 | Clark | |
| 5,469,706 | A | 11/1995 | Hoya | |
| 5,598,696 | A | 2/1997 | Stotts | |
| 5,605,287 | A | 2/1997 | Mains | |
| 5,882,514 | A | 3/1999 | Fletcher | |
| 5,954,495 | A | 9/1999 | Knöpfel et al. | |
| 6,021,635 | A | 2/2000 | Gaag et al. | |
| 6,029,910 | A | 2/2000 | Joshi et al. | |
| 6,076,356 | A | 6/2000 | Pelletier | |
| 6,082,113 | A | 7/2000 | Prociw et al. | |
| 6,247,317 | B1 | 6/2001 | Kostka | |
| 6,276,141 | B1 | 8/2001 | Pelletier | |
| 6,289,676 | B1 * | 9/2001 | Prociw et al. | 60/740 |
| 6,431,467 | B1 | 8/2002 | Joshi et al. | |
| 6,539,724 | B2 | 4/2003 | Cornwell et al. | |
| 6,715,292 | B1 * | 4/2004 | Hoke | 60/748 |
| 6,823,677 | B2 | 11/2004 | Prociw et al. | |
| 6,883,332 | B2 * | 4/2005 | Steinthorsson et al. | 60/776 |
| 6,889,499 | B2 | 5/2005 | Bassani | |
| 7,043,922 | B2 | 5/2006 | Thompson et al. | |
| 7,096,722 | B2 | 8/2006 | Benson et al. | |
| 7,117,678 | B2 | 10/2006 | Sampath et al. | |
| 7,174,717 | B2 | 2/2007 | Prociw | |
| 7,430,851 | B2 | 10/2008 | Patwari | |
| 7,454,914 | B2 | 11/2008 | Prociw | |
| 7,513,116 | B2 | 4/2009 | Hebert et al. | |
| 7,520,134 | B2 | 4/2009 | Durbin et al. | |
| 7,536,862 | B2 | 5/2009 | Held et al. | |
| 7,540,141 | B2 * | 6/2009 | Goldberg | F02C 7/22 60/39.281 |
| 7,658,074 | B2 | 2/2010 | Tuttle | |
| 7,712,313 | B2 | 5/2010 | Kojovic et al. | |
| 7,878,000 | B2 | 2/2011 | Mancini et al. | |
| 7,926,282 | B2 | 4/2011 | Chew et al. | |
| 8,006,500 | B1 | 8/2011 | Wilson, III | |
| 8,015,815 | B2 | 9/2011 | Pelletier et al. | |
| 8,033,113 | B2 | 10/2011 | Patel et al. | |
| 8,047,003 | B2 | 11/2011 | Yoshida et al. | |
| 8,091,362 | B2 | 1/2012 | Smith | |
| 8,122,721 | B2 | 2/2012 | Johnson et al. | |
| 8,205,643 | B2 | 6/2012 | Lee et al. | |
| 8,240,151 | B2 | 8/2012 | Pelletier et al. | |
| 8,272,218 | B2 | 9/2012 | Fox et al. | |
| 8,336,313 | B2 * | 12/2012 | McMasters et al. | 60/742 |
| 2005/0279862 | A1 * | 12/2005 | Mao et al. | 239/403 |
| 2007/0193272 | A1 | 8/2007 | Hebert et al. | |
| 2009/0255262 | A1 * | 10/2009 | McMasters | F23R 3/14 60/742 |
| 2010/0037614 | A1 | 2/2010 | York | |
| 2010/0051728 | A1 | 3/2010 | Hicks | |
| 2010/0162714 | A1 | 7/2010 | Rice et al. | |
| 2010/0251720 | A1 | 10/2010 | Pelletier et al. | |
| 2010/0307159 | A1 | 12/2010 | Toon | |
| 2011/0056204 | A1 | 3/2011 | Ryan | |
| 2011/0067403 | A1 * | 3/2011 | Williams | F23R 3/286 60/742 |
| 2011/0067404 | A1 | 3/2011 | Johnson et al. | |
| 2011/0085895 | A1 | 4/2011 | Durocher et al. | |
| 2011/0247590 | A1 | 10/2011 | Donovan | |
| 2012/0024985 | A1 | 2/2012 | Johnson et al. | |
| 2012/0151930 | A1 * | 6/2012 | Patel | F23D 11/383 60/746 |
| 2012/0240592 | A1 | 9/2012 | Keny et al. | |

FOREIGN PATENT DOCUMENTS

| | | | |
|---|---|---|---|
| FR | 2817017 | A1 | 5/2002 |
| GB | 831477 | A | 3/1960 |
| WO | WO2009126485 | A2 | 10/2009 |

OTHER PUBLICATIONS

Extended European Search Report, European Application No. 13842187.0, May 9, 2016, 10 pages.

* cited by examiner

FLOW MODIFIER FOR COMBUSTOR FUEL NOZZLE TIP

BACKGROUND

The present invention relates generally to fuel nozzles, and more particularly to fuel nozzle tips suitable for use in a gas turbine engine combustor.

Gas turbine engines include a combustor for generating combustion products to help power the engine. Typically, compressed air is provided to the combustor and is mixed with fuel injected into a combustion chamber. The fuel/air mixture is ignited to provide combustion. The combustion products then exit the combustor and pass through a turbine section that extracts rotational energy from the combustion products.

Fuel nozzles deliver fuel in particular patterns to help facilitate combustion. Parameters such as swirl, velocity, and pressure are tightly controlled by the fuel nozzle to help promote desired performance. During operation, fuel nozzles that inject fuel in the combustor are subjected to extreme thermal conditions as well as various other forces. Balancing these concerns in a working fuel nozzle can be difficult.

It is therefore desired to provide an alternative fuel nozzle tip.

SUMMARY

A fuel injector nozzle assembly includes a body extending along an axis and a core swirl plug positioned at least partially within the body. The core swirl plug has a flow modifying structure configured to swirl fuel at a location upstream from a distal end of the nozzle assembly.

Figure 1:
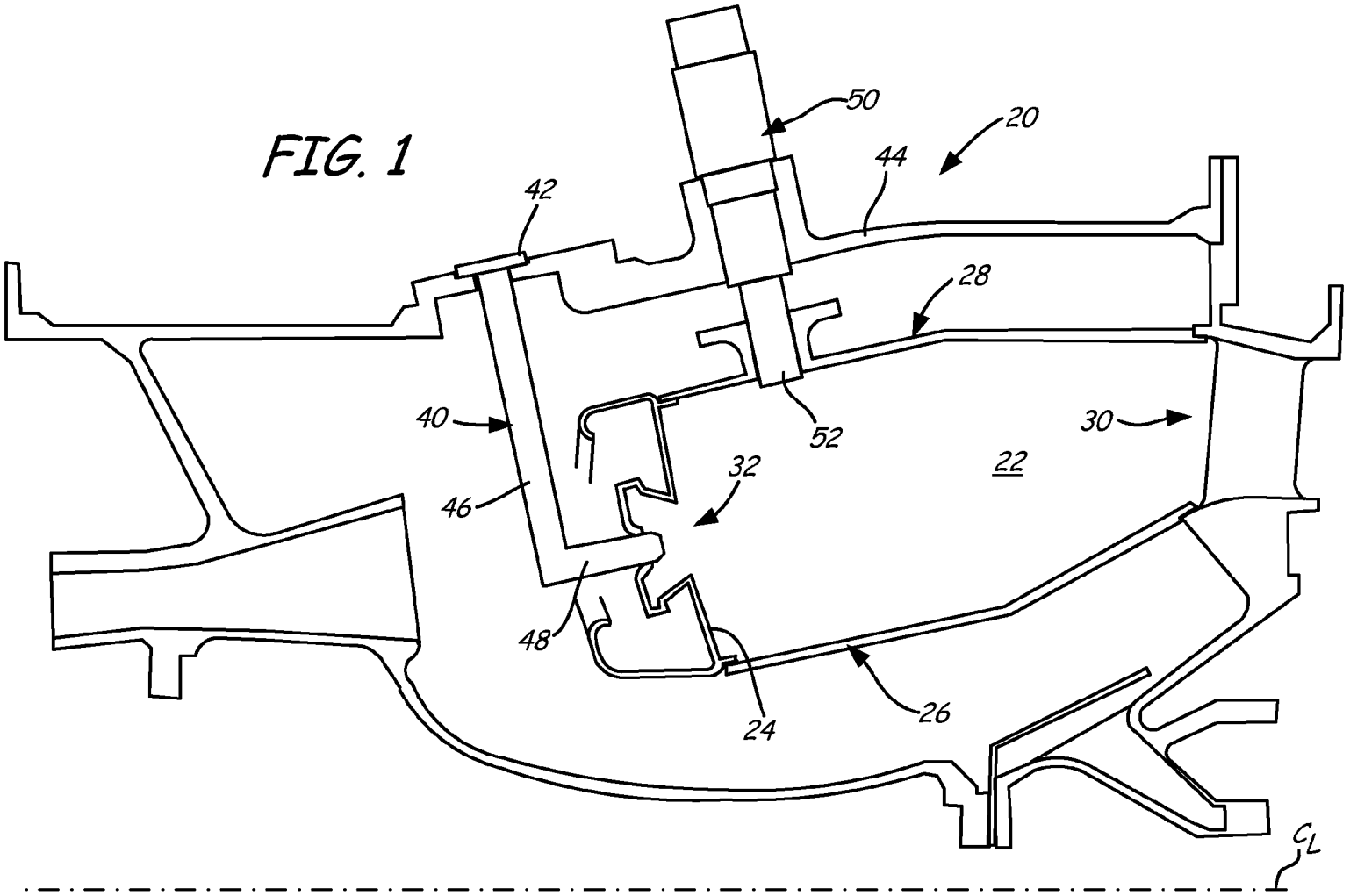
FIG. 1 is a cross sectional view of an embodiment of a combustor section.

While the above-identified figures set forth embodiments of the present disclosure, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings.

DETAILED DESCRIPTION

FIG. 1 is a cross-sectional view of an embodiment of a gas turbine engine combustor section 20 having a generally annular combustion chamber 22. For simplicity, cross hatching is omitted and only an upper half of the combustor section above an engine centerline axis $C_L$ is shown in FIG. 1. The combustion chamber 22 in the illustrated embodiment is bounded by a bulkhead 24, inner wall 26 and outer wall 28 extending from the bulkhead 24 to an outlet 30 located upstream of a turbine section (not shown). The bulkhead 24 and the walls 26 and 28 can be of double layer construction with an outer shell and an inner panel array. The bulkhead 24 and the walls 26 and 28 can each include suitable thermal barrier coatings and/or cooling fluid openings. One or more swirlers 32 can be mounted to the bulkhead 24 that provide one or more corresponding upstream fluid inlets to the combustion chamber 22, for instance, using compressed air from a compressor section (not shown). The swirlers 32 can be angularly spaced about the engine centerline in any desired pattern, in desired radial positions. A fuel nozzle 40 can be associated with each swirler 32. Different fuel nozzles 40 can have different configurations, as desired for particular applications, or can have a substantially identical configuration. For instance, any given nozzle 40 can have a simplex, duplex or other configuration, as explained further below. In the illustrated embodiment, the fuel nozzle 40 has an outboard flange 42 secured to an engine case 44. A support (or leg) 46 extends generally radially from the flange 42, and can include suitable internal passageways for fluid (e.g., fuel) transport. A nozzle tip 48 can be supported at a distal end of the nozzle 40. The nozzle tip 48 can extend into the associated swirler 32 and can have outlets for introducing fuel (e.g., liquid jet fuel) to air flowing through the swirler 32. One or more igniters 50 can be mounted to the case 44 and can have tip portions 52 extending into the combustion chamber 22 for igniting a fuel/air mixture passing downstream from the swirlers 32 and the fuel nozzles 40.

In one embodiment, duplex, simplex or other types of fuel nozzles can be interspersed at different locations around the combustor section 20, as desired. Duplex fuel nozzles provide two fuel delivery paths to the combustion chamber 22 while simplex fuel nozzles provide one fuel delivery path to the combustion chamber 22. It is possible to provide fuel nozzles with nearly any number of desired fuel delivery paths, such as having three or more paths. Separate fuel delivery paths can allow separate and independent control of fuel flow through each path, and/or other benefits. For example, one fuel path can be used to provide a pilot while one or more additional fuel paths selectively provide fuel for other operating modes. Alternatively, all of the nozzles 40 in the combustor section 20 can be of the same configuration (e.g., simplex, duplex, etc.).

During operation, hot air flow is present at or near the swirlers 32 and at least portions of the nozzles 40 (e.g., the support 46 and/or nozzle tip 48). The nozzles 40 can use fuel passing through the nozzle tips 48 as a heat sink to help cool the nozzles 40, as explained further below.

It should be noted that the embodiment of the combustor section 20 shown in FIG. 1 is presented by way of example only, and not limitation. Various other combustor configurations are possible. For instance, a can combustor configuration is possible in alternative embodiments. Moreover, although the combustor section 20 is usable with a gas turbine engine, explanation of operation of the engine as a whole is unnecessary here because gas turbine engines are well known.

Figure 2:
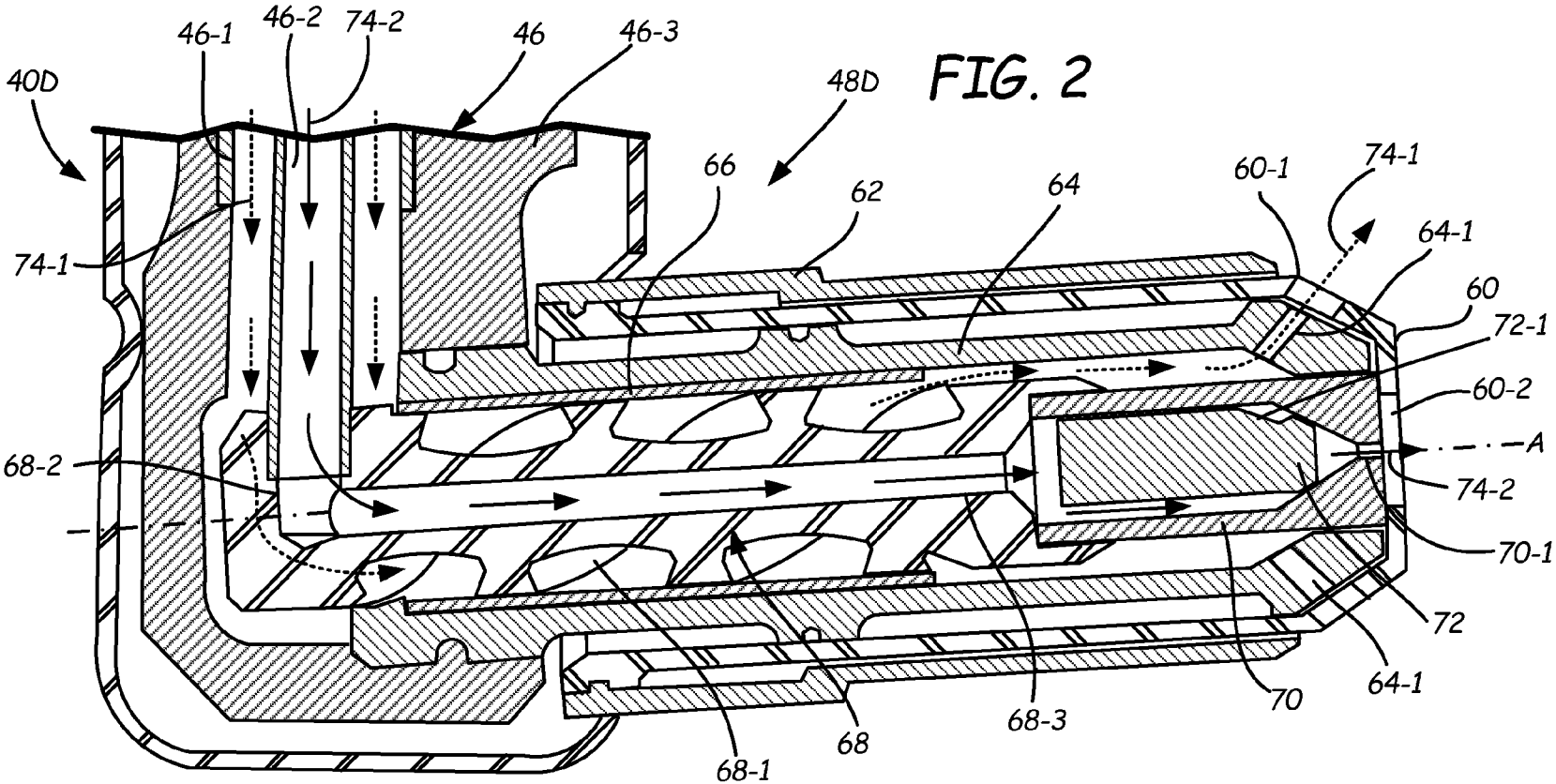
FIG. 2 is a cross-sectional view of an embodiment of a duplex fuel nozzle tip of the combustor section.

FIG. 2 is a cross-sectional view of an embodiment of a duplex fuel nozzle 40D and fuel nozzle tip 48D. As shown in the embodiment of FIG. 2, the nozzle tip 48D includes a heat shield 60, an outer sleeve 62, a body 64, a heat shield sleeve 66, a core swirl plug 68, an inner body 70, and a swirl plug 72. Furthermore, as shown in the embodiment of FIG. 2, the support 46 includes concentric tubes 46-1 and 46-2 and a body 46-3. Arrows are shown in FIG. 2 to schematically represent fuel flow paths 74-1 and 74-2, though it should be appreciated that fuel may or may not be flowing along either path 74-1 or 74-2 under any given operating condition.

The heat shield 60 may be positioned at least partially about or surrounding the body 64; and, the outer sleeve 62 may be positioned at least partially about or surrounding the heat shield 60. The body 64 may have a generally cylindrical shape forming an interior cavity. The core swirl plug 68 may be positioned at least partially within the body 64. The inner body 70 can also be positioned at least partially within the body 64. In the illustrated embodiment, the inner body 70 is positioned downstream of and directly adjacent to the core swirl plug 68. The swirl plug 72 can be positioned at least partially within the inner body 70. The heat shield sleeve 66 can be positioned in between the core swirl plug 68 and the body 64, such that the core swirl plug 68 is spaced from the body 64 and does not physically contact the body 64. The heat shield sleeve 66 can be made as a physically separate element from the body 64 (i.e., not monolithic and unitary). In the illustrated embodiment, the heat shield sleeve 66 is axially shorter than the core swirl plug 68, and has an upstream end that is generally axially aligned with an upstream end of the body 64.

The fuel flow path 74-1 (or secondary fuel path) can pass through a generally annular passage formed between the concentric tubes 46-1 and 46-2, and can continue along a periphery of the core swirl plug 68. The fuel flow path 74-1 can have a generally annular shape. Furthermore, the fuel flow path 74-1 can be arranged concentrically with the fuel flow path 74-2, at least in a location where those paths 74-1 and 74-2 enter the nozzle tip 48D. As shown in the illustrated embodiment, the core swirl plug 68 has a generally cylindrical shape and includes at least one rib 68-1 along an outer surface. The rib 68-1 can be arranged in a helical shape that wraps around the axis A, such that at least a portion of the fuel flow path 74-1 can follow a helical groove present between turns of the rib 68-1. In the illustrated embodiment, the rib 68-1 has a frustum or substantially triangular cross-sectional shape, with a relatively narrow radially inward base that adjoins a generally cylindrical body portion of the core swirl plug 68 and with a relatively wide radially outward surface opposite the radially inward base. The rib 68-1 can be formed integrally and monolithically with a remainder of the core swirl plug 68 in one embodiment. The relatively wide radially outward surface of the rib 68-1 can help provide desired contact with the heat shield sleeve 66.

The rib 68-1 of the core swirl plug 68 may cause a swirling movement of the fuel passing along the path 74-1, thereby increasing a velocity of the fuel. The rib 68-1 may extend radially across the entire pathway of the fuel flow path 74-1, for at least a portion of the flow path 74-1, to flow the passing fuel in a swirling direction before reaching the downstream or distal end of the nozzle tip 48D where it exits the nozzle 40 for combustion. In this respect, the core swirl plug 68, including the rib 68-1, can act as a flow-modifying member to alter flow of the fuel through the nozzle tip 48D. The core swirl plug 68 can be located well upstream from the downstream end of the nozzle tip 48D, such that the velocity of the fuel is modified proximate to the support 46 and prior to reaching the passages 64-1 in the body 64. The relatively high fuel velocity produced by the core swirl plug 68 helps scrub thermal energy from the fuel nozzle tip 48D, because the fuel acts like a heat sink. It should be noted that fuel swirling produced by the core swirl plug 68 may be entirely separate and independent from air swirling produced by the swirler 32 that may be spaced from the fuel nozzle tip 48D.

The fuel flow path 74-2 (or primary fuel path) can pass through an interior passage of the tube 46-2, and then through a passage (or bore) 68-2 defined by the core swirl plug 68 and another passage (or bore) 68-3 defined by the core swirl plug 68. The passage 68-3 can be defined at an interior or radially central portion of the core swirl plug 68 and the passage 68-2 can be arranged at or near a proximal or upstream end of the core swirl plug 68, with the passages 68-2 and 68-3 arranged to turn a direction of fuel flow in a desired manner. In the illustrated embodiment, the fuel flow path 74-2 is positioned radially inward of the fuel flow path 74-1 along the nozzle tip 48D. The fuel flow path 74-2 may have a generally cylindrical shape, in contrast to the generally annular shape of the flow path 74-1. The core swirl plug 68 can therefore provide swirling flow along its exterior, adjacent to the rib 68-1, and generally non-swirling flow along the internal passage 68-3. The passage 68-3 can be arranged parallel to and concentric with the axis A. The fuel flow path 74-2 can continue from the passage 68-3 to the inner body 70, where fuel can pass along grooves 72-1 defined in an outer portion of the swirl plug 72 and through the opening 70-1 defined by the inner body 70. The swirl plug 72 can impart swirl and tangential momentum to fuel passing to a conical weir defined as part of the opening 70-1 of the inner body 70. Due to conservation of momentum, a reduction of radius across the conical weir (opening 70-1) of the inner body 70 increases swirl velocity, such that fuel can leave exit orifice formed by the opening 70-1 as a thin sheet of fuel that then breaks into ligaments.

The heat shield sleeve 66 helps protect at least a portion of the fuel flow path 74-1 from relatively high heat conditions and hot surfaces, in order to help keep fuel passing along the path 74-1 below a fuel coking limit. Functionally, the heat shield sleeve 66 works to reduce or limit a surface temperature of components (e.g., core swirl plug 68) that come in contact with the fuel in order to help reduce or prevent fuel coking. Fuel coking is undesirable, and can result in the formation of solid carbonaceous materials that may deposit on surfaces and obstruct fuel flow, and may potentially obstruct the passages 64-1 and/or openings 60-1. It has presently been discovered that thermal energy present in the body 46-3 of the support 46 may travel through the body 64, because the body 46-3 abuts the body 64. Thermal contact resistance between surfaces of the body 64 and the heat shield sleeve 66 helps reduce conductive transfer of thermal energy to the fuel, such as to reduce thermal energy transfer from the body 46-3 of the support 46 through the body 64 to the fuel.

Generally radially angled openings 60-1 and a generally axially oriented opening 60-2 can be provided in the heat shield 60 to allow fuel to exit the nozzle tip 48D. Likewise, generally radially angled passages 64-1 can be provided in the body 64, and a generally axial opening 70-1 can be provided in the inner body 70. The radially angled passages 64-1 can be aligned with the radially angled openings 60-1, and the axial passage 70-1 can be aligned with the axial opening 60-2. However, it should be understood that operating conditions, including thermal gradients, can affect alignment of passages and openings. The radially angled openings 60-1 and the radially angled passages 64-1 can be oriented at any desired angle, but are generally oriented more radially than the opening 60-2 and the passage 70-1 that may be oriented along the central axis A of the nozzle tip 48D (which may or may not be parallel with the engine centerline axis $C_L$). In one embodiment, the radially angled openings 60-1 and the radially angled passages 64-1 are each oriented at approximately 50° relative to the axis A, and the opening 60-2 and the passage 70-1 are each oriented parallel to and concentric with the axis A. Radial orientation of the openings 60-1 and the passages 64-1 allow for generally radial fuel jets to be formed by fuel passing through the fuel path 74-1, which provides a particular fuel injection pattern.

It has been discovered that the radial fuel jets formed by the fuel passing through the fuel path 74-1 affect the thermal characteristics of the nozzle tip 48D. For instance, in order to produce radial fuel jets, the fuel must pass along the path 74-1 relative close to the axis A before turning radially outward, which affects the ability of the fuel to act as a heat sink for thermal energy absorbed by the upstream portions of the nozzle tip 48D near the support 46. Increased velocity of the fuel and the swirling effect produced by the core swirl plug 68 help to reduce a risk of fuel coking due to fuel contact with relatively hot surfaced while still allowing the use of radial fuel jets.

In one embodiment, the fuel path 74-2 may provide constant fuel supply for a pilot, while the fuel path 74-1 can provide controllable fuel flows that vary as desired (e.g., as a function of throttle control). In alternate embodiments, other configurations and fuel control schemes can be used.

Figure 3:
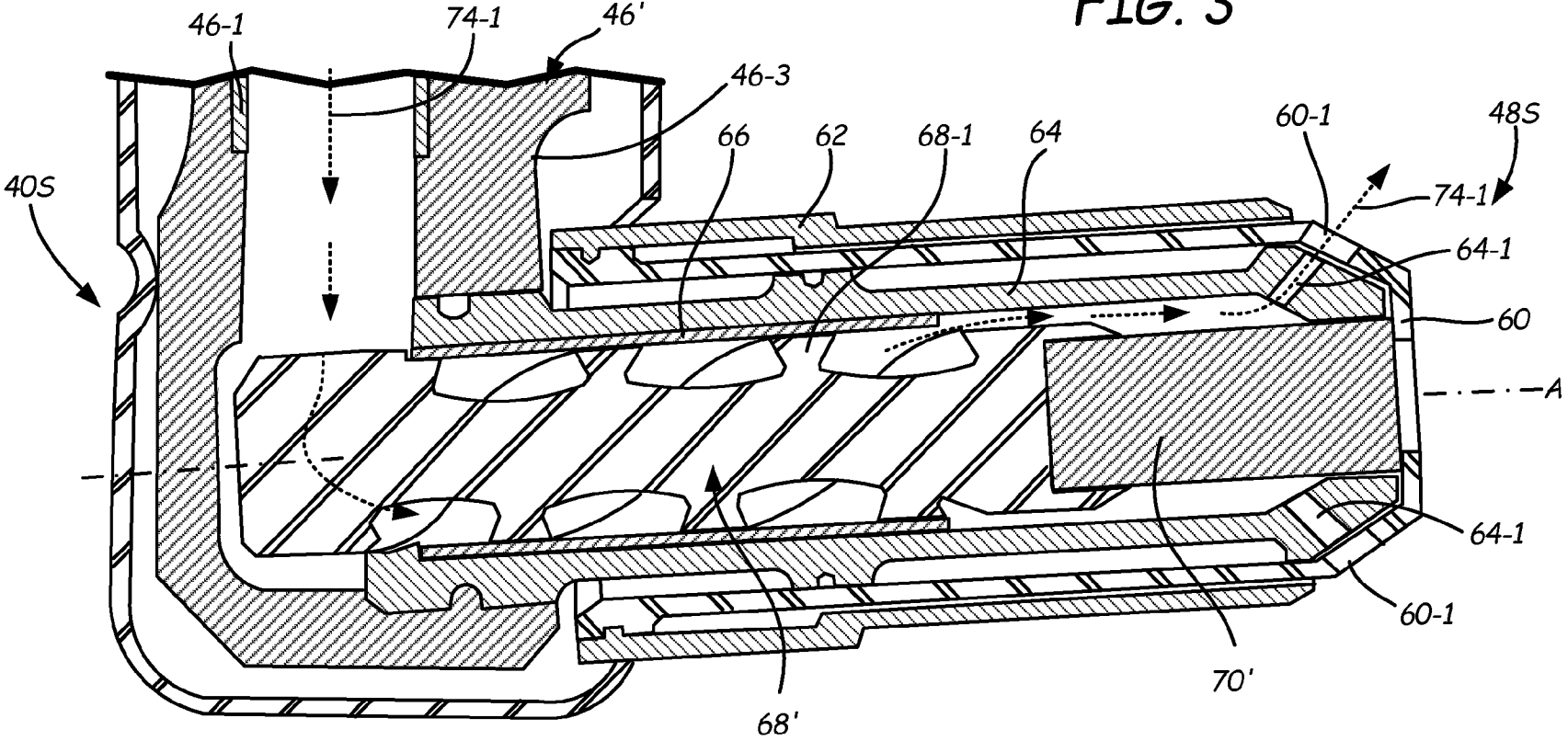
FIG. 3 is a cross-sectional view of an embodiment of a simplex fuel nozzle tip of the combustor section.

FIG. 3 is a cross-sectional view of an embodiment of a simplex fuel nozzle 40S and fuel nozzle tip 48S. The simplex fuel nozzle 40S can provide a single fuel path, as opposed to the two fuel paths provided by the duplex nozzle 40D described above. As shown in the embodiment of FIG. 3, the nozzle tip 48S includes a heat shield 60, an outer sleeve 62, a body 64, a heat shield sleeve 66, a core swirl plug 68', and an inner body 70'. Furthermore, as shown in the embodiment of FIG. 3, the support 46' includes a tube 46-1 and a body 46-3. Arrows are shown in FIG. 3 to schematically represent a fuel flow path 74-1, though it should be appreciated that fuel may or may not be flowing along the path 74-1 under any given operating condition. In general, the fuel flow path 74-1 is similar to that described above with respect to the duplex embodiment of the fuel nozzle 48D. However, the fuel flow path 74-2 of the duplex fuel nozzle 48D is omitted in the simplex embodiment of the nozzle 48S. Common components of the simplex and duplex nozzles 40S and 40D can generally operate similarly. However, because the fuel flow path 74-2 is omitted in the nozzle 48S, the core swirl plug 68' can omit internal passages and the inner body 70' can omit the passage 70-1. Furthermore, the nozzle 48S can omit the tube 46-2 and the swirl plug 72 of the duplex nozzle 48D.

The simplex and duplex nozzles 40S and 40D can be modular in the sense that most components can be common between the different configurations, with certain components omitted or simplified in the simplex embodiment, as discussed above. Modular construction helps simplify and streamline manufacturing and assembly and reduces a total number of unique parts.

Discussion of Possible Embodiments

The following are non-exclusive descriptions of possible embodiments of the present invention.

A fuel injector nozzle assembly can include a body extending along an axis; and a core swirl plug positioned at least partially within the body, the core swirl plug having a flow modifying structure configured to swirl fuel at a location upstream from a distal end of the nozzle assembly.

The assembly of the preceding paragraph can optionally include, additionally and/or alternatively, any one or more of the following features, configurations and/or additional components:

the flow modifying structure can comprise a helical rib extending radially outward;

the helical rib can have a substantially frustum cross-sectional shape;

a heat shield sleeve positioned between the body and the core swirl plug;

the core swirl plug and the body can be spaced from each other;

a passage in the core swirl plug, wherein a fuel flow path passes along an outer surface of the core swirl plug and another fuel flow path passes through the core swirl plug along the passage;

a fuel outlet passage that extends through the body at an angle relative to the axis to permit fuel injection in a generally radial direction; and/or the passage can be arranged concentrically with the axis.

A combustor assembly for a gas turbine engine combustor can include a combustion chamber; a first fuel injector nozzle configured to inject fuel into the combustion chamber, the fuel injector nozzle including: a body extending along an axis; a core swirl plug positioned at least partially within the body, the core swirl plug having a flow modifying structure.

The assembly of the preceding paragraph can optionally include, additionally and/or alternatively, any one or more of the following features, configurations and/or additional components:

the flow modifying structure can comprise a helical rib extending radially outward;

the helical rib can have a substantially frustum cross-sectional shape;

the core swirl plug and the body can be spaced from each other;

a passage in the core swirl plug, wherein a fuel flow path passes along an outer surface of the core swirl plug and another fuel flow path passes through the core swirl plug along the passage;

the first fuel injector nozzle can have a simplex configuration, the assembly further including a second fuel injector nozzle configured to inject fuel into the combustion chamber, the fuel injector nozzle having a duplex configuration and including: a body extending along an axis; and a core swirl plug positioned at least partially within the body, the core swirl plug having a flow modifying structure and a passage, wherein a fuel flow path passes along an outer surface of the core swirl plug adjacent to the flow modifying structure and another fuel flow path passes through the core swirl plug along the passage;

the second fuel injector nozzle can further include a heat shield sleeve positioned between the body and the core swirl plug;

the passage can be arranged concentrically with the axis;

the flow modifying structure can be configured to swirl fuel at a location upstream from the distal end of the nozzle assembly; and/or a support having a support body and a tube configured to carry fuel, wherein the support body abuts the body; and a heat shield sleeve positioned between the body and the core swirl plug of the first fuel injector nozzle.

A method for injecting fuel into a gas turbine engine combustor can include moving fuel along an at least partially annular fuel path; ejecting fuel from the at least partially annular fuel path, wherein the fuel is ejected at a downstream end of a nozzle tip; and swirling the fuel moving along the at least partially annular fuel path upstream from the downstream end of the nozzle tip.

The method of the preceding paragraph can optionally include, additionally and/or alternatively, any one or more of the following features and/or additional steps:

reducing thermal energy transfer to the fuel in the nozzle tip at a location adjacent to a support that adjoins the nozzle tip;

moving fuel along another fuel path radially inward from the at least partially annual fuel path;

wherein the fuel is swirled while in contact with relatively hot surfaces to reduce fuel coking; and/or ejecting fuel moving along the radially inward fuel path from the downstream end of the nozzle tip along the axis.

Any relative terms or terms of degree used herein, such as "substantially", "essentially", "generally" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, alignment or shape variations induced by thermal or vibrational operational conditions, and the like.

While the disclosure is described with reference to an exemplary embodiment(s), it will be understood by those skilled in the art that various changes may be made and equivalents may be substituted for elements thereof without departing from the scope of the disclosure. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims. For example, components illustrated or described as being separate structures can be integrally and monolithically formed in further embodiments, such as using direct metal laser sintering (DMLS) processes.

The invention claimed is:

1. A fuel injector nozzle assembly comprising:

a body extending along an axis;

a support having a support body abutting the body and configured to carry fuel to the body;

a core swirl plug positioned at least partially within the body, the core swirl plug having a central passage for a first fuel flow, a fuel flow path along an outer surface of the core swirl plug for a second fuel flow, and a flow modifying structure configured to swirl the second fuel flow at a location upstream from a distal end of the nozzle assembly, wherein a portion of the flow modifying structure is positioned proximate to the support body, and wherein the flow modifying structure extends along a majority of the body in an axial direction; and a heat shield sleeve positioned concentrically between the body and the core swirl plug, wherein the heat shield sleeve does not contact the support, and the core swirl plug does not contact the body or the support, wherein the flow modifying structure is a rib.

2. The assembly of claim 1, wherein the rib is a helical rib.

3. The assembly of claim 2, wherein the helical rib has a frustum cross-sectional shape.

4. The assembly of claim 1, wherein the core swirl plug and the body are spaced from each other.

5. The assembly of claim 1 and further comprising:

a fuel outlet passage that extends through the body at an angle relative to the axis to permit fuel injection in a generally radial direction.

6. The assembly of claim 1, wherein said fuel flow path along the outer surface is a helical channel having multiple turns.

7. The assembly of claim 6, wherein said helical channel is adjacent to said distal end of the fuel injector nozzle assembly.

8. The assembly of clam 1, wherein said body includes a multiple of radial orifices.

9. The assembly of claim 1, further comprising an outer sleeve that at least partially surrounds said heat shield sleeve.

10. The assembly of claim 9, wherein said first fuel flow is a primary fuel flow, said second fuel flow is a secondary fuel flow, and said fuel flow path along the outer surface is a helical channel having multiple turns.

11. A combustor assembly for a gas turbine engine combustor, the assembly comprising:

a combustion chamber;

a first fuel injector nozzle configured to inject fuel into the combustion chamber, the first fuel injector nozzle including:

a body extending along an axis and having a fuel outlet passage that extends through the body at an angle to permit fuel injection into the combustion chamber in a generally radial direction;

a support having a support body and a tube configured to carry fuel, wherein the support body abuts the body;

a core swirl plug positioned at least partially within the body, the core swirl plug having a central passage for a first fuel flow, a fuel flow path along an outer surface of the core swirl plug for a second fuel flow, and a flow modifying structure, wherein the flow modifying structure is a rib that extends along a majority of the body in an axial direction; and a heat shield sleeve positioned concentrically between the body and the core swirl plug of the first fuel injector nozzle, wherein the heat shield sleeve does not contact the support, and the core swirl plug does not contact the body or the support.

12. The assembly of claim 11, wherein the rib a helical rib.

13. The assembly of claim 12, wherein the helical rib has a frustum cross-sectional shape.

14. The assembly of claim 11, wherein the core swirl plug and the body are spaced from each other, and wherein the core swirl plug and the body each define portions of a boundary of the fuel flow path along the outer surface.

15. The assembly of claim 11, further comprising:

a second fuel injector nozzle configured to inject fuel into the combustion chamber, the second fuel injector nozzle having a duplex configuration and including:

a second body extending along an second axis; and a second core swirl plug positioned at least partially within the second body, the second core swirl plug having a second flow modifying structure and a second passage, wherein a fuel flow path passes along an outer surface of the second core swirl plug adjacent to the second flow modifying structure and another fuel flow path passes through the second core swirl plug along the second passage.

16. The assembly of claim 11, wherein the flow modifying structure is configured to swirl the second fuel flow along a majority of an axially extending portion of the first fuel injector nozzle.

17. The assembly of claim 11, wherein the heat shield sleeve contacts the flow modifying structure of the core swirl plug of the first fuel injector nozzle.

18. The assembly of claim 15, wherein the second body of the second fuel injector nozzle has a common configuration with the body of the first fuel injector nozzle.

19. The assembly of claim 11, wherein said fuel flow path along the outer surface is a helical channel having multiple turns.

20. The assembly of claim 19, wherein a portion of said helical channel is adjacent to said fuel outlet passage of the first fuel injector nozzle.

21. The assembly of clam 11, wherein said body includes a multiple of radial orifices.

22. The assembly of claim 11, further comprising an outer sleeve that at least partially surrounds said heat shield sleeve.

23. The assembly of claim 22, wherein said first fuel flow is a primary fuel flow, said second fuel flow is a secondary fuel flow and said fuel flow path along the outer surface is helical channel haying multiple turns.

24. A method for injecting fuel into the combustor assembly of the gas turbine engine combustor according to claim 11, the method comprising:

delivering the second fuel flow to the fuel flow path along the outer surface;

moving the second fuel flow along the fuel flow path along the outer surface;

ejecting the second fuel flow at a downstream end of the first fuel injector nozzle in a generally radially outward direction; and swirling the second fuel flow moving along the fuel flow path along the outer surface upstream from the downstream end of the first fuel injector nozzle to help reduce fuel coking, and wherein the rib is helical.

25. The method of claim 24, and further comprising:

shielding the support from thermal energy transfer with the heat shield sleeve.

26. The method of claim 24 and further comprising:

moving the first fuel flow along the central passage radially inward from the fuel flow path along the outer surface.

27. The method of claim 26 and further comprising:

ejecting the first fuel flow moving along the central passage from the downstream end of the first fuel injector nozzle along the axis.

* * * * *